US010212978B2

(12) United States Patent
Canady

(10) Patent No.: US 10,212,978 B2
(45) Date of Patent: Feb. 26, 2019

(54) HITCH FOR CYCLING SKIRT AND METHOD OF USING SAME

(71) Applicant: Karen S. Canady, Los Angeles, CA (US)

(72) Inventor: Karen S. Canady, Los Angeles, CA (US)

( * ) Notice: Subject to any disclaimer, the term of this patent is extended or adjusted under 35 U.S.C. 154(b) by 0 days.

(21) Appl. No.: 14/875,351

(22) Filed: Oct. 5, 2015

(65) Prior Publication Data

US 2016/0021956 A1 Jan. 28, 2016

Related U.S. Application Data

(62) Division of application No. 14/174,810, filed on Feb. 6, 2014, now Pat. No. 9,149,082.

(Continued)

(51) Int. Cl.

| | |
|---|---|
| ***A41F 19/00*** | (2006.01) |
| ***A41F 17/02*** | (2006.01) |
| ***A41D 1/14*** | (2006.01) |

(52) U.S. Cl.

CPC ..... *A41F 19/00* (2013.01); *A41D 1/14* (2013.01); *A41F 17/02* (2013.01); *A41D 2600/104* (2013.01)

(58) Field of Classification Search

CPC . A41D 13/04; A41F 9/00; A41F 19/00; A41F 17/02

(Continued)

(56) References Cited

U.S. PATENT DOCUMENTS

| | | | |
|---|---|---|---|
| 209,413 | A | 10/1878 | Moses |
| 461,434 | A | 10/1891 | Henry |

(Continued)

FOREIGN PATENT DOCUMENTS

| | | |
|---|---|---|
| AT | 12397 | 5/2012 |
| GB | 191211633 | 0/1912 |

OTHER PUBLICATIONS

Michaela via Shirley, The Ribbon Retreat Blog Editor, "Bubble Skirt Tutorial", Aug. 23, 2012, http://www.theribbonretreat.com/blog/buble-skirt-tutorial.html, pp. 1-4 and 12.*

(Continued)

*Primary Examiner* — Alissa Tompkins
*Assistant Examiner* — Brieanna Szafran
(74) *Attorney, Agent, or Firm* — Karen S. Canady; canady + lortz LLP

(57) ABSTRACT

A hitch for lifting the hem of a skirted garment, or garment set comprising a skirt and hitch. The hitch comprises a strip of flexible fabric with coacting fastening means affixed near each end of its length, securing the hitch in a loop when fastened. The fastening means may comprise a button and buttonhole, a snap, a hook-and-loop fastening system, or other fastening means. The garment set can include a hitch featuring a button and buttonhole, and a skirt that comprises a waistband and a second button, the second button affixed to the waistband. One method of removably securing in a raised position a portion of a skirt comprises passing a garment hitch under the hemline of the skirt; passing the garment hitch through the band of the garment; and fastening the garment hitch to itself, thereby forming a secured loop whereby the hitch circumscribes the portion of the skirt.

7 Claims, 6 Drawing Sheets

Related U.S. Application Data

(60) Provisional application No. 61/762,847, filed on Feb. 8, 2013.

(58) Field of Classification Search
USPC ..... 2/300, 211, 220, 236, 309, 311, 321
See application file for complete search history.

(56) References Cited

U.S. PATENT DOCUMENTS

| | | | | | |
|---|---|---|---|---|---|
| 494,064 | A | | 3/1893 | Johnston | |
| 521,998 | A | * | 6/1894 | Zeller/Crager | A41D 1/14 2/212 |
| 546,496 | A | | 9/1895 | Peck | |
| 555,428 | A | | 2/1896 | Bygrave | |
| 555,682 | A | | 3/1896 | Davis | |
| 584,909 | A | | 6/1897 | Voorhis | |
| 596,759 | A | | 1/1898 | Newberger | |
| 604,310 | A | | 5/1898 | Fergus | |
| 616,026 | A | | 12/1898 | Stein | |
| 709,862 | A | | 9/1902 | Baughman | |
| 724,758 | A | | 4/1903 | Todd | |
| 729,208 | A | | 5/1903 | Nicholson | |
| 769,970 | A | | 9/1904 | Wertheimer | |
| 905,705 | A | | 12/1908 | Johnson | |
| 911,630 | A | | 2/1909 | Tolman | |
| 1,174,976 | A | * | 3/1916 | Gaines | A41D 1/20 2/221 |
| 1,354,933 | A | | 10/1920 | Wissmann | |
| 1,530,504 | A | | 3/1925 | Lenkowsky | |
| 2,334,144 | A | * | 11/1943 | Bono | A41D 1/20 2/235 |
| 3,045,246 | A | | 7/1962 | Hoff | |
| 3,812,539 | A | | 5/1974 | Muehlberg | |
| 4,580,298 | A | | 4/1986 | Tuisl | |
| D300,682 | S | | 4/1989 | Ciavatta | |
| 4,920,579 | A | | 5/1990 | Swain | |
| 4,947,489 | A | | 8/1990 | Greenwood | |
| 5,299,323 | A | | 4/1994 | Schafer | |
| 5,327,586 | A | * | 7/1994 | Evans | A41D 1/14 2/211 |
| 5,787,511 | A | | 8/1998 | Garside | |
| 6,081,925 | A | | 7/2000 | Reiber | |
| 6,339,848 | B1 | | 1/2002 | Mayhood | |
| 6,681,405 | B2 | | 1/2004 | Yachimec | |
| D490,215 | S | | 5/2004 | Gonzales | |
| 6,865,751 | B1 | | 3/2005 | Brasher | |
| 7,039,958 | B2 | | 5/2006 | Henricksen | |
| D613,479 | S | | 4/2010 | Farmer | |
| D614,379 | S | | 4/2010 | Campbell | |
| D693,992 | S | | 11/2013 | Dinunzio | |
| D698,128 | S | | 1/2014 | Cabrera | |
| D714,024 | S | | 9/2014 | Adams | |
| D727,596 | S | | 4/2015 | Barber | |
| 2003/0037363 | A1 | | 2/2003 | Speier | |
| 2006/0254598 | A1 | * | 11/2006 | Saul | A61F 5/03 128/876 |
| 2009/0055998 | A1 | * | 3/2009 | Blumenfeld | A41B 9/14 2/403 |
| 2012/0297524 | A1 | | 11/2012 | Stem | |
| 2014/0135674 | A1 | * | 5/2014 | Kirk | A61F 5/026 602/20 |

OTHER PUBLICATIONS

All About Ribbon Infographic: Grossgrain, https://ribbons.com/All-About-Grosgrain-Ribbon pp. 1-2.*

* cited by examiner

HITCH FOR CYCLING SKIRT AND METHOD OF USING SAME

This application is a divisional of application Ser. No. 14/174,810, filed Feb. 6, 2014, now U.S. Pat. No. 9,149,082, issued Oct. 6, 2015, which application claims the benefit of provisional patent application No. 61/762,847, filed Feb. 8, 2013. The disclosure of the provisional application and any publications cited herein are hereby incorporated by reference into this application.

TECHNICAL FIELD OF THE INVENTION

The invention relates generally to garments and accessories for use with garments, particularly garments characterized by flowing fabric, such as skirts, dresses, robes, tunics and the like. The invention also relates to a device and method for hitching up such garments. The hitch can be used to avoid tripping or entanglement of the flowing fabric in bicycle spokes and other equipment, as well as to create a stylistic impression.

BACKGROUND OF THE INVENTION

Cycling and other activities can be especially enjoyable when wearing a skirt, as skirts allow free, unrestricted movement of the legs and do not pose the hazard of catching in the chain as do pant legs. Some skirts, however, are of a length that is most pleasant for off-bicycle activities, such as working at an office, dining out, running errands, or socializing, but are a bit too long to remain clear of the spokes on a bicycle wheel and other equipment. Shorter skirts can be problematic for modesty and other reasons. While one solution might be to wear knickers, bloomers, pantaloons, or shorts, these garments fail to provide the freedom of movement and off-bicycle benefits of a skirt.

There remains a need for devices and methods to permit the enjoyment of cycling in a skirt without risk of entanglement in spokes or other equipment.

SUMMARY OF THE INVENTION

The invention meets this need and others by providing materials and methods for the reversible hitching of a skirt. The invention provides, in one embodiment, a hitch for lifting the hem of a skirted garment, or a garment set comprising a skirt and hitch. The hitch typically comprises a strip of flexible fabric with coacting fastening means affixed near each end of its length, securing the hitch in a loop when fastened. The fastening means may comprise a button and buttonhole, a snap, a hook-and-loop fastening system, or other fastening means. The garment set can include a hitch featuring a button and buttonhole, and a skirt that comprises a waistband and a second button, the second button affixed to the waistband. One method of removably securing in a raised position a portion of a skirt comprises passing a garment hitch under the hemline of the skirt; passing the garment hitch through the band of the garment; and fastening the garment hitch to itself, thereby forming a secured loop whereby the hitch circumscribes the portion of the skirt. Other methods are described hereinbelow.

DETAILED DESCRIPTION OF THE INVENTION

Figure 1A:
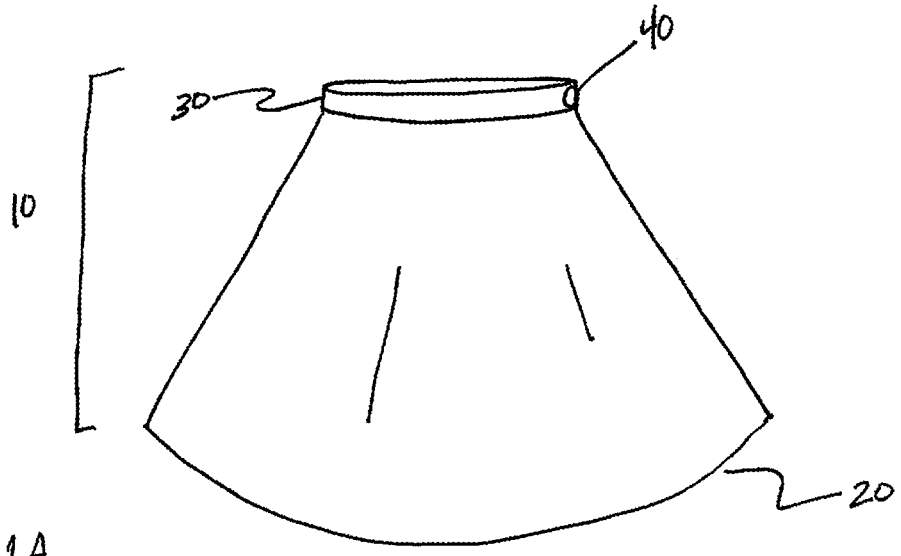
FIG. 1A illustrates a front view of a representative skirt 10 that is laid out flat, the skirt having a hem 20 and waistband 30. A button 40 (optional) is affixed to the waistband 30.

The present invention is based on the discovery of a clever means of improving the ease of cycling in a skirt, while also creating a stylistic impression. The hitch and method described herein can be used to lift the hem of a skirted garment at a selected point (or points). The lifting of the hem can be just enough to create an intriguing feature, optionally revealing an interesting and/or fashionable undergarment, or it can be used to secure a sufficient portion of the skirt so as to avoid excessive flying up of the skirt or entanglement of the skirt in other objects. The hitch can be removably fastened to the garment, and can be easily transformed between a raised and lowered position. The hitch can be fastened to the garment in such a way that, when disengaged from the raised position, the hitch is out of sight (underneath the fabric of the skirt). Alternatively, it can be fastened so that, when lowered, it is visible and free to flutter along with the fabric of the skirt as the wearer moves about.

Definitions

All scientific and technical terms used in this application have meanings commonly used in the art unless otherwise specified. As used in this application, the following words or phrases have the meanings specified.

As used herein, a "portion of a skirt" means less than all of the skirt. Typically, the portion comprises less than half of fabric of the complete skirt.

As used herein, a "band" of the garment refers to a waistband, belt loop, or other loop that is affixed to the garment. Typically, the band is sewn into the garment, forming an integral part of the garment.

As used herein, "flexible fabric" means that the fabric can easily be folded back on itself, e.g., to form a loop. In some embodiments, the fabric does not stretch, thereby maintaining a constant, fixed length. In alternative embodiments, the fabric is stretchable, such as an elastic band or elastic cord.

As used herein, a "raised position" means elevated to a position higher than a previous or unsecured position.

As used herein, "a" or "an" means at least one, unless clearly indicated otherwise.

Garment and Hitch

The invention provides a hitch for use with a skirt or other garment. The hitch can be used to lift the garment hem and secure the hemline at a raised level by looping around a portion of the garment. The hitch is typically looped around the garment in a substantially vertical manner, thereby allowing the gathered hemline to drape downward from the raised position. The portion of garment hem, such as a portion of a relatively full skirt, may be bunched or wadded together and secured within the hitch, retaining excess fabric in a position less likely to pose a hindrance to travel by bicycle or other activity, such as horseback or motorcycle riding. A particularly long or bulky skirt may be managed by use of a second hitch.

The hitch may be secured to the garment by looping around the garment, such as by looping around the entire length of the skirt, from hemline to waistband. Alternatively, the hitch may be secured to the garment by passing through a loop or slot that forms a part of the garment. A loop may be a conventional belt loop, disposed in a substantially vertical position, or it may be disposed in a horizontal or diagonal position. The loop may be affixed to the exterior of the garment, or it may be affixed to the interior of the garment. The loop may be of fabric, either the same or different from the rest of the garment fabric, or the loop may be made of metal, plastic or other suitable material.

The hitch can be a closed loop, much like a rubber band, and be secured to the garment by an openable fastening means that is affixed to the garment. Alternatively, the hitch can be an open loop that can be secured using a coacting fastening means.

In one embodiment, a garment set is provided. The garment set comprises a skirt and a hitch, wherein the hitch comprises a strip of flexible fabric having a width of 0.4 to 15 centimeters, a length of 15 to 56 centimeters, and a depth of 0.02 to 0.4 centimeters. The strip of fabric comprises coacting fastening means affixed within 7 centimeters of each end of the length, the coacting fastening means securing the hitch in a loop when fastened to one another. In one embodiment, the coacting fastening means comprises a button and buttonhole. In one embodiment, the strip of fabric comprises grosgrain ribbon. In a representative embodiment, the ribbon is about 2-3 centimeters in width and about 40-50 centimeters in length. In one embodiment, the fastening means comprises a button and buttonhole, wherein the skirt further comprises a waistband and a second button, wherein the second button is affixed to the waistband.

The garment set can optionally comprise a second hitch. The first and/or second hitch can be fastened to the garment directly, such as by buttoning onto a button sewn onto the waistband of the garment. Alternatively, the first and/or second hitch can be an entirely separate piece that fastens to itself via the coacting fastening means, and is secured to the garment by forming a loop around the garment, such as from hemline to waistband, with skirt fabric gathered within the loop formed by the hitch.

Method of Hitching Garment

A method of removably securing in a raised position a portion of a skirt of a garment is also provided. The garment to which the method is applied comprises a hemline and a band, wherein the hemline defines a lower edge of the garment, and the band defines either a circumference of the garment or a loop affixed to the garment. The method comprises passing a garment hitch under the hemline of the skirt portion, and passing the garment hitch through the band of the garment. The method further comprises fastening the garment hitch to itself, thereby forming a secured loop whereby the hitch circumscribes the portion of the skirt of the garment.

In one embodiment, the band comprises a waistband. In another embodiment, the band comprises a loop affixed to the exterior or interior of the garment.

In one embodiment, the garment hitch is fastened to itself using coacting fastening means. Representative fastening means include, but are not limited to: a button and buttonhole, a hook and eye, a hook and loop fastener, a toggle and buttonhole, a snap, a tab and loop, and a buckle.

In one embodiment, the hitch comprises a ribbon, a fabric strip, a shoestring, nylon webbing, or a cord. In one embodiment, the hitch comprises a ribbon having first and second ends, and further comprises a first buttonhole disposed at the first end of the ribbon, and a button disposed at the second end of the ribbon. The hitch is removably fastened to itself by passing the button through the first buttonhole.

In another embodiment, the garment comprises a waistband and a first button affixed to the waistband. In this embodiment, the hitch comprises a ribbon having first and second ends, and further comprises a first buttonhole disposed at the first end of the ribbon, and a second buttonhole and a second button disposed at the second end of the ribbon. The hitch is removably attached to the waistband via passing the first button through the first buttonhole, and the hitch is fastened to itself by then passing the first button through the second buttonhole. An attractive aesthetic is formed by the juxtaposition of the first and second buttons when fastened in this manner.

EXAMPLES

The following examples are presented to illustrate the present invention and to assist one of ordinary skill in making and using the same. The examples are not intended in any way to otherwise limit the scope of the invention.

Example 1: Skirt Adapted to Receive Hitch

Figure 1B:
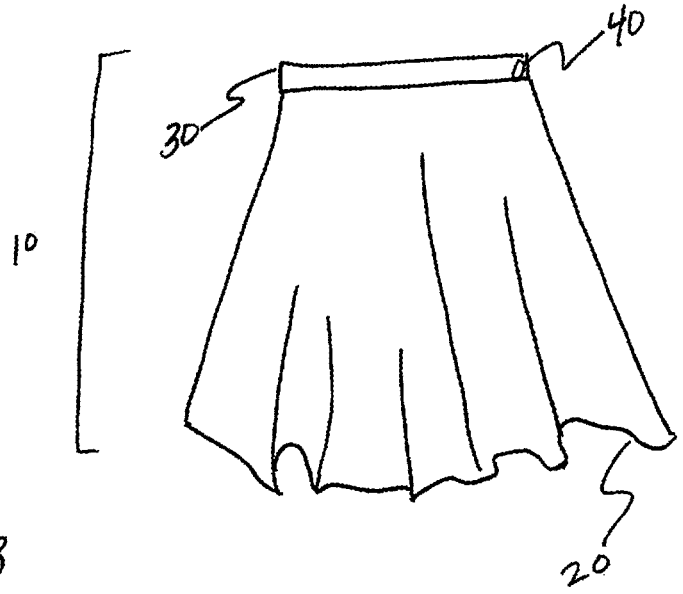
FIG. 1B illustrates a skirt 10 as in FIG. 1A, but with the skirt fabric draping downward, as it would when hung from the waistband 30, or when worn.

This example demonstrates a skirt having a button sewn to its waistband, making it easy to attach and remove a hitch. A front view of such a skirt is shown in FIG. 1A. The skirt 10 that is laid out flat, and has a hem 20 and waistband 30. A button 40 is affixed to the waistband 30. The same skirt, as it would appear if suspended from a hanger or draped over a wearer is shown in FIG. 1B, with the skirt fabric draping downward from the waistband 30. The button 40 could be replaced with a hook, a toggle, a loop, a snap, a hook-and-loop (VELCRO™) tab, as can be readily appreciated by one skilled in the art.

Example 2: Hitch with Button and Buttonholes

Figure 2A:
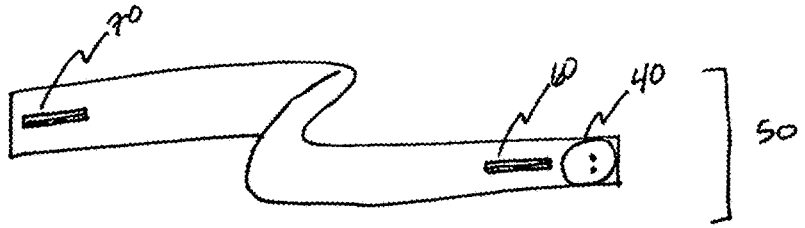
FIG. 2A illustrates a front view of one embodiment of a hitch 50, in which a button 40 is affixed at one end, adjacent to a first buttonhole 60. A second buttonhole 70 is disposed near the opposite end of the hitch 50.

FIG. 2A illustrates one embodiment of a hitch 50, in which a button 40 is affixed at one end, adjacent to a first buttonhole 60. A second buttonhole 70 is disposed near the opposite end of the hitch 50. The two buttonholes 60, 70 make it easy to attach the hitch to the skirt of Example 1 and also to itself.

Figure 2B:
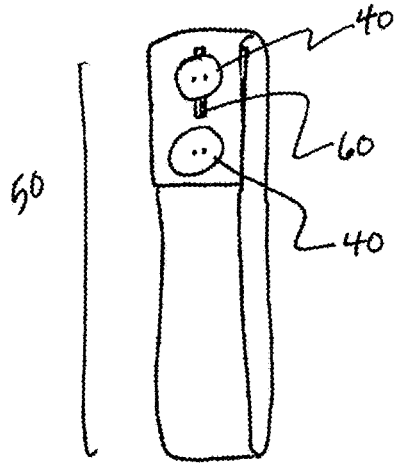
FIG. 2B illustrates the hitch 50 of FIG. 2A when looped around with the end having a button 40 and the first buttonhole 60 folded over the opposite end. In this view, a button 40 has been passed through buttonhole 70 and buttonhole 60, securing the hitch 50 in a loop and creating the visual effect of two adjacent buttons 40.
Figure 2C:
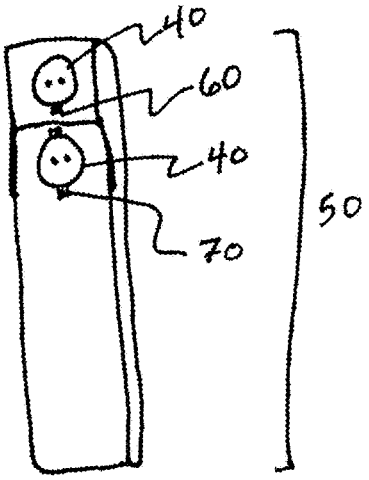
FIG. 2C illustrates an alternative arrangement of the same hitch 50 shown in FIGS. 2A and 2B, when looped around with the buttonhole 70 at the end lacking a button coming up to meet the button 40 from the other end of the hitch 50. This arrangement leaves the other buttonhole 60 available to fasten onto a second button 40 on the waistband of a skirt, and allows for concealment of the hitch 50 under the skirt when unbuttoned at buttonhole 70.

FIG. 2B illustrates the hitch 50 of FIG. 2A when looped around and fastened to itself. The end having a button 40 and the first buttonhole 60 is folded over the opposite end. A button 40 is shown after insertion through buttonhole 70 and buttonhole 60, securing the hitch 50 in a loop and creating the visually pleasing effect of two adjacent buttons 40. A similar aesthetic can be achieved with the same hitch 50 arranged differently, as shown in FIG. 2C. In this latter configuration, the hitch 50 falls discretely under the skirt when disengaged from button 40 at buttonhole 70.

Figure 3A:
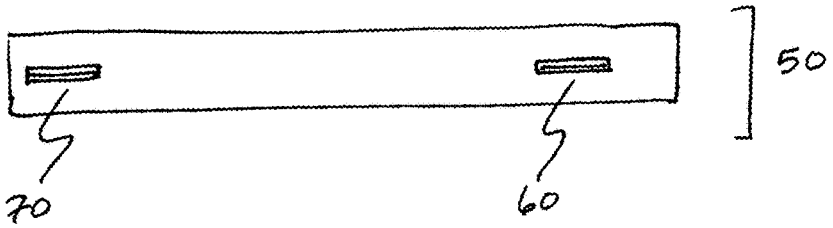
FIG. 3A illustrates a rear view of the hitch 50 shown in FIG. 2A, straightened and with buttonholes 60 and 70 visible.
Figure 3B:
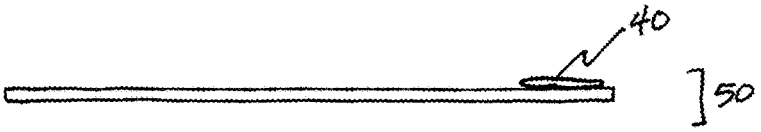
FIG. 3B illustrates a side view of the hitch 50 shown in FIGS. 2A and 3A. The other side view would be a mirror image of this side view.

FIGS. 3A and 3B illustrate rear and side views of the hitch 50 shown in FIG. 2A, straightened and with buttonholes 60 and 70 visible. This embodiment of the hitch is typically made with a strip of woven fabric or a ribbon, such as grosgrain ribbon. One can appreciate alternatives, such as using a cord with loops in lieu of buttonholes, or substituting snaps or other fastening means for the button-buttonhole arrangement.

Example 3: Skirt with Hitch Buttoned to Waistband

Figure 4A:
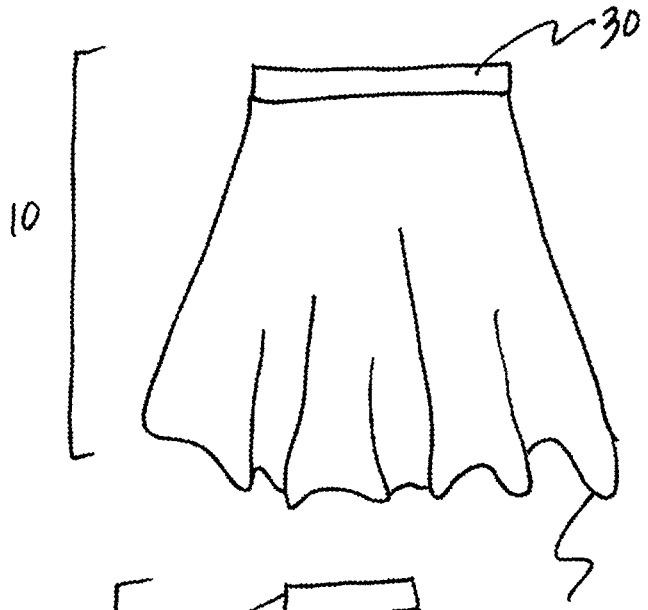
FIG. 4A illustrates a rear view of the skirt 10 shown in FIG. 1B. The waistband 30 and hem 20 are visible.
Figure 4B:
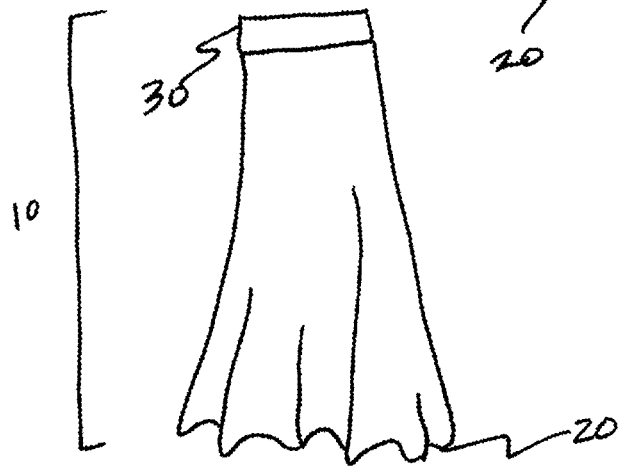
FIG. 4B illustrates a side view of the skirt 10 shown in FIGS. 2A, 3A and 4A, with the waistband 30 and hem 20 visible. The other side view would be a mirror image of this side view.
Figure 5:
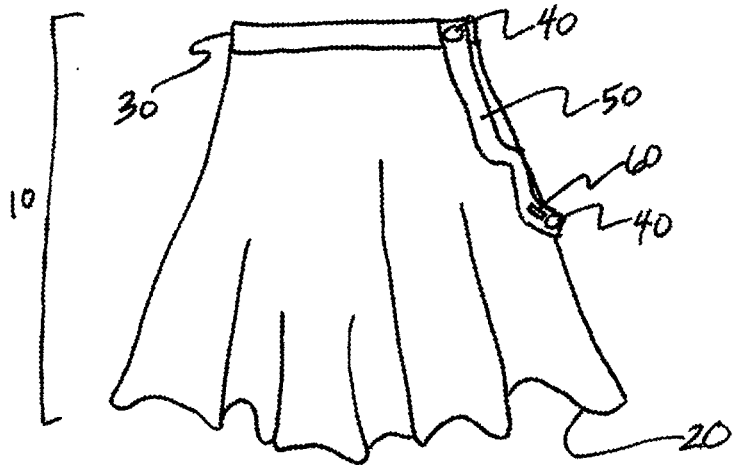
FIG. 5 is a front view of the skirt 10 shown in FIG. 2A, with a hitch 50 affixed to the button 40 on waistband 30 via buttonhole 70 (obscured by button 40). The hitch is free to drape over the skirt, weighted by the button 40 adjacent to unoccupied buttonhole 60.

FIGS. 4A and 4B illustrate rear and side views of the skirt 10 shown in FIG. 1B, with the waistband 30 and hem 20 visible. These views are generally indistinguishable from a typical skirt with waistband. FIG. 5 is a front view of the skirt 10 shown in FIG. 2A, with a hitch 50 affixed to the button 40 on waistband 30 via buttonhole 70 (the buttonhole being obscured by button 40). The hitch is free to drape over the skirt, weighted by the button 40 adjacent to unoccupied buttonhole 60. Wearing the hitch dangling from the waistband in this manner can add an element of fun, as the lightweight hitch having a button or other object at the end will flutter with the wearer's movement. If the hitch is not needed to lift the skirt hemline while riding a bicycle, it can be fun to allow the hitch to flutter along in the breeze behind the cyclist.

Figure 6A:
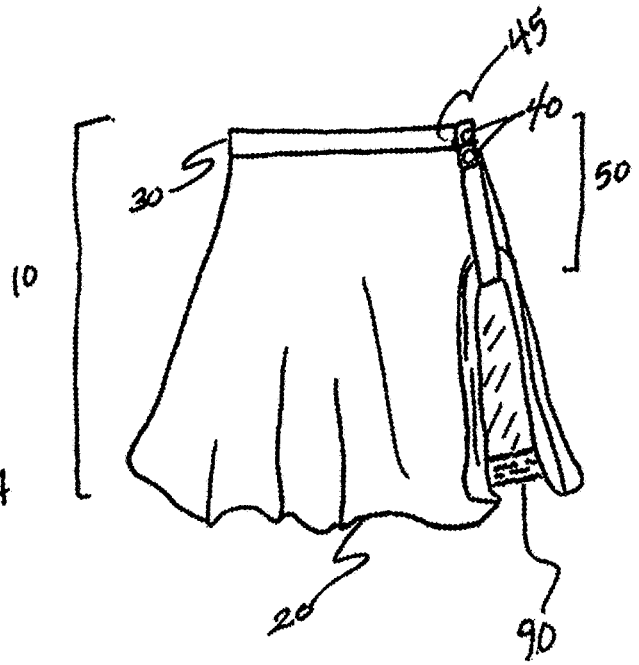
FIG. 6A is a front view of the skirt 10 shown in FIG. 5, with the hitch 50 looped under the skirt 10 and over the waistband 30 and affixed to the button 40 on the waistband 30 via buttonholes 70 and 60. The hem 20 is lifted by the hitch 50, revealing an undergarment 90.
Figure 6B:
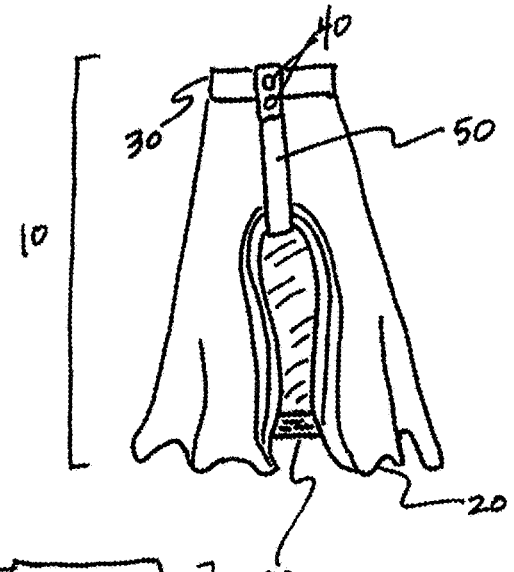
FIG. 6B is a side view of the skirt 10 as shown in FIG. 6A.

FIG. 6A is a front view of the skirt 10 shown in FIG. 5, with the hitch 50 looped under the skirt 10 and over the waistband 30 and affixed to the button 40 on the waistband 30 via buttonholes 70 and 60. Further, the hitch 50 may pass through a band 45 comprising a loop affixed to the exterior or the interior of the skirt 10. The hem 20 is lifted by the hitch 50, revealing an undergarment 90. If the underside of the skirt is of a contrasting color relative to the outside of the skirt, this display can also add an accent of color to the look. In this view, the skirt 10 is worn with the hitch 50 at the side. FIG. 6B is a side view of the skirt 10 as shown in FIG. 6A. Alternatively, the wearer can slide the skirt around the waist to position the hitch where desired. The wearer can also choose, of course, to wear the skirt 10 with or without an undergarment 90 that is revealed when the skirt 10 is lifted by the hitch 50.

Figure 7:
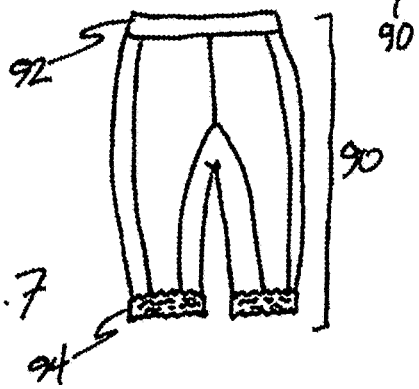
FIG. 7 illustrates one embodiment of an undergarment 90 having a waistband 92 and hemmed with a lace trim 94.

FIG. 7 illustrates one embodiment of an undergarment 90 having a waistband 92 and hemmed with a lace trim 94. The undergarment 90 can have a color and/or print that creates an interesting visual contrast when revealed when the hemline 20 is lifted, either by the hitch 50 or simply by being caught by a breeze, such as might occur while cycling, or riding on a scooter.

Example 4: Dress with Hitch

Figure 8:
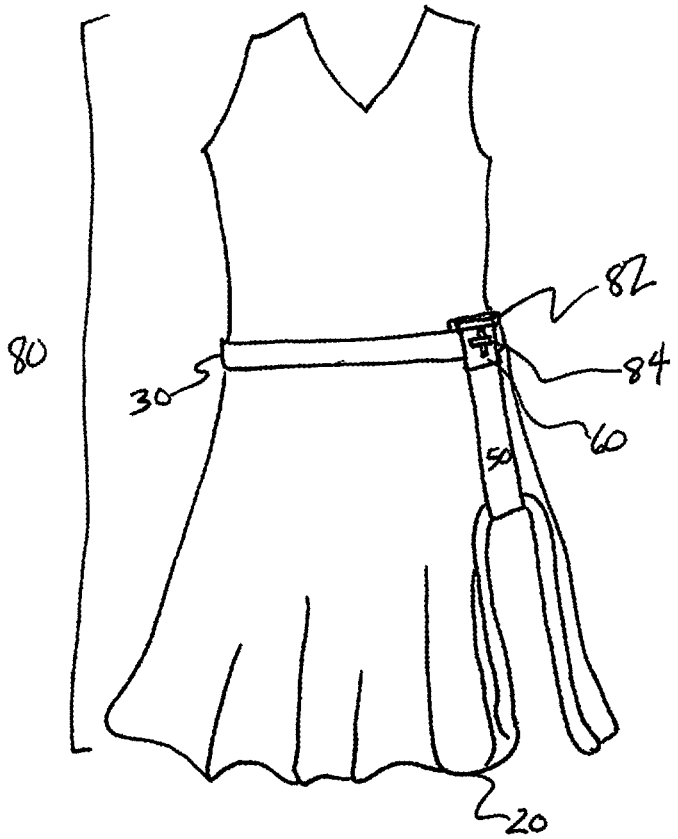
FIG. 8 illustrates an embodiment in which a dress 80 features an opening or slot 82 near the waistband 30. The hitch 50 passes through the slot 82 and buttons to itself via a toggle 84 and buttonhole 60, thereby lifting the hem 20 of the dress 80.

FIG. 8 illustrates an embodiment in which a dress 80 features an opening or slot 82 near the waistband 30. The hitch 50 passes through the slot 82 and buttons to itself via a toggle 84 and buttonhole 60, thereby lifting the hem 20 of the dress 80. Similar arrangements can be used to adapt the hitch for use with robes, tunics and other garments that cover the upper as well as lower body.

Figure 10:
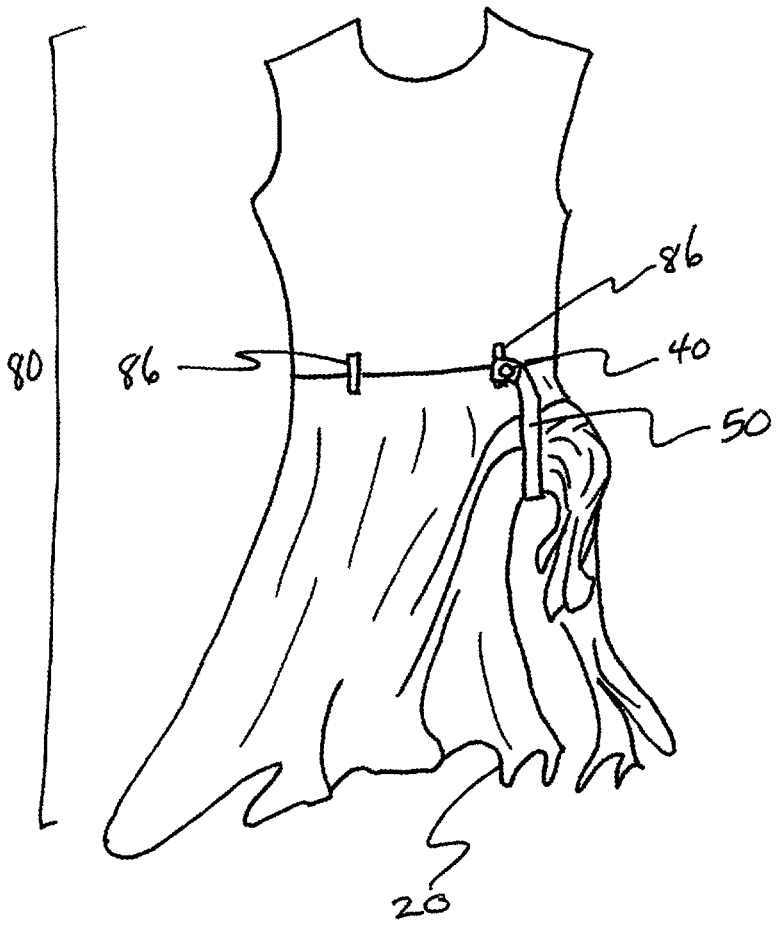
FIG. 10 illustrates an embodiment in which a dress 80 has belt loops 86 to which a hitch 50 is secured as a loop outside of the garment by fastening to itself via the button 40. A portion of the hemline 20 is pulled up through the loop formed by the hitch, and can be knotted or otherwise arranged to secure the hemline in a raised position.

FIG. 10 illustrates an embodiment in which a dress 80 has belt loops 86 to which a hitch 50 is secured as a loop outside of the garment by fastening to itself via the button 40. A portion of the hemline 20 is pulled up through the loop formed by the hitch, and can be knotted or otherwise arranged to secure the hemline in a raised position. This modification can also be applied to skirts.

Example 5: Longer Skirt with Multiple Hitches

Figure 9:
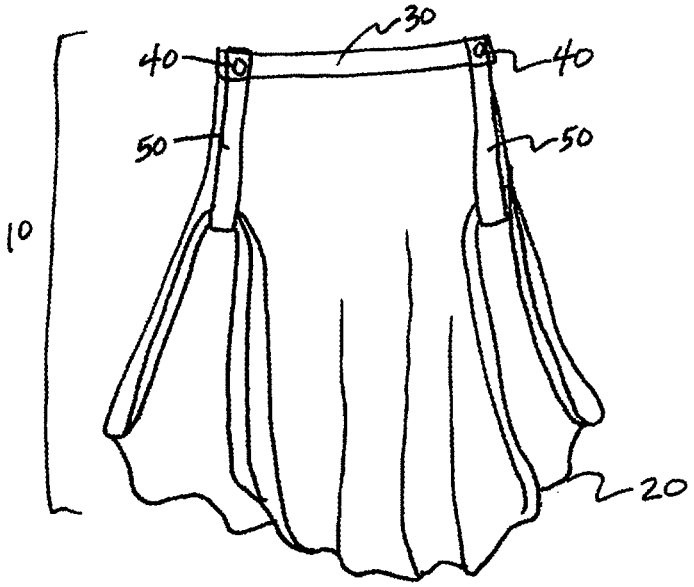
FIG. 9 illustrates an embodiment of the skirt 10 in which two hitches 50 are used to lift a longer hemline 20 up toward the waistband 30. The hitches 50 are each secured to themselves via buttons 40.

FIG. 9 illustrates an embodiment of the skirt 10 in which two hitches 50 are used to lift a longer hemline 20 up toward the waistband 30. The hitches 50 are each secured to themselves via buttons 40. Because it is not necessary to attach the hitch 50 directly to the garment, one can use a hitch with garments not specially adapted for use with a hitch. This also makes it easy to use more than one hitch with the same garment.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A garment set comprising a skirt and a hitch, wherein the skirt further comprises a waistband, a hemline, and a fastening means affixed to the waistband, wherein the hitch is capable of being removably fastened to the waistband of the skirt, the hitch having a width of 0.4 to 15 centimeters, a length of 15 to 56 centimeters, and a depth of 0.02 to 0.4 centimeters, wherein the hitch comprises coacting fastening means affixed within 7 centimeters of each end of the length, the coacting fastening means securing the hitch in a loop when fastened to one another, and the coacting fastening means removably fastening the hitch to the fastening means affixed to the waistband, wherein the loop secured by fastening the coacting fastening means to one another circumscribes the entire length of the skirt in a vertical manner.

2. The garment set of claim 1, wherein the coacting fastening means comprises a first button and a first buttonhole disposed at one end of the hitch and a second buttonhole disposed at the opposite end of the hitch, and wherein the fastening means affixed to the waistband of the skirt comprises a second button.

3. The garment set of claim 1, wherein the hitch is a strip of flexible fabric of grosgrain ribbon.

4. The garment set of claim 3, wherein the grosgrain ribbon is about 2-3 centimeters in width and about 40-50 centimeters in length.

5. The garment set of claim 3, wherein the fastening means comprises a button or toggle, and a buttonhole.

6. A method of removably securing in a raised position a portion of the skirt of the garment set of claim 1, wherein the hemline defines a lower edge of the skirt, the method comprising:

(a) passing the hitch under the hemline of the portion of the skirt;

(b) passing the hitch over the waistband of the skirt; and (c) fastening the hitch to itself, thereby forming the loop whereby the hitch circumscribes the portion of the skirt.

7. The method of claim 6, wherein the hitch comprises a ribbon, a fabric strip, a shoestring, nylon webbing, or a cord.

* * * * *